US007251906B2

(12) United States Patent
Kajihara et al.

(10) Patent No.: US 7,251,906 B2
(45) Date of Patent: Aug. 7, 2007

(54) DRUM TYPE WASHING AND DRYING MACHINE

(75) Inventors: Hiroshi Kajihara, Hyogo (JP); Yoshitomo Kato, Osaka (JP); Satoshi Maeda, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/128,347

(22) Filed: May 13, 2005

(65) Prior Publication Data

US 2006/0037213 A1 Feb. 23, 2006

(30) Foreign Application Priority Data

Aug. 20, 2004 (JP) ..... 2004-240475

(51) Int. Cl.
*F26B 11/02* (2006.01)

(52) U.S. Cl. ..... 34/603; 34/480; 34/474; 68/17 R

(58) Field of Classification Search ..... 34/82, 34/596, 603, 474, 557, 468, 480; 68/24, 68/17 R, 19
See application file for complete search history.

(56) References Cited

U.S. PATENT DOCUMENTS 2,827,783 A * 3/1958 Handley ..... 68/12.15

FOREIGN PATENT DOCUMENTS

GB 1 554 725 10/1979
JP 2000-093697 4/2000

* cited by examiner

*Primary Examiner*—Kenneth Rinehart
(74) *Attorney, Agent, or Firm*—Bacon & Thomas, PLLC

(57) ABSTRACT

A drum type washing and drying machine includes a rotary drum for accommodating laundry therein; a front frame for forming a front surface of a main body of the washing and drying machine, wherein the front frame is provided with a laundry loading/unloading opening through which laundry is loaded into or unloaded from the rotary drum; a detergent dispenser accommodated in the front frame; a dryer filter, accommodated in the front frame, for collecting therein lint generated during a drying process; and a control panel for setting an operation of the main body and displaying an operating state thereof. The dryer filter and the detergent dispenser are substantially symmetrically disposed with respect to the control panel interposed therebetween.

3 Claims, 4 Drawing Sheets

DRUM TYPE WASHING AND DRYING MACHINE

FIELD OF THE INVENTION

The present invention relates to a drum type washing and drying machine for performing washing, rinsing, water-extracting and drying processes in a rotary drum having a substantially horizontal or slanted rotational axis.

BACKGROUND OF THE INVENTION

A conventional drum type washing and drying machine includes a cylindrical rotary drum disposed in a water tub such that its rotational axis is horizontal or slanted with respect to the horizontal direction. The cylindrical rotary drum having a bottom surface is provided with multiple drum perforations for allowing water and air to pass therethrough on its cylindrical surface and is driven to rotate. Further, formed at a front side of the water tub is a laundry loading/unloading opening, which is opened and closed with a door. After loading laundry in the rotary drum through the laundry loading/unloading opening, washing, rinsing and water-extracting processes are performed by controlling water supply and drain into and from the water tub and also by controlling the rotation of the rotary drum.

Moreover, by forming an air circulation channel for exhausting air from the water tub, running thus exhausted air through a dehumidification unit and a heating unit and re-circulating thus dehumidified and heated air back into the water tub, a drying process for drying laundry accommodated in the rotary drum can be performed. In such a way, the drum type washing and drying machine is capable of executing the drying process in addition to the washing, the rinsing and the water-extracting process. Detergent can be added into a detergent dispenser prior to starting the operation of the drum type washing and drying machine and a control panel can be manipulated as needed to set up a desired operation process of the washing and drying machine, start or temporarily pause the operation, and find out the operation status thereof.

In the drum type washing and drying machine having the above-described configuration, a lint trap filter for filtering, e.g., lint produced from laundry during the drying process is installed in the air circulation channel in order to prevent the lint from being accumulated in the air circulation channel or in a fan. The lint trap filter is configured to be attached to or detached from the drum type washing and drying machine by opening a lid plate provided on a top surface of a main body of the drum type washing and drying machine so that the lint collected in the lint trap filter can be removed at any time. By removing the lint, deterioration of air flow efficiency can be prevented (see, for example, Japanese Patent Laid-open Application No. 2000-093697).

However, given that the lint trap filter is disposed at an upper portion of the main body and the lid plate opened or closed to mount or separate the lint trap filter is installed on the top surface of the main body in the conventional drum type washing and drying machine, the lint trap filter is typically hidden from view. Therefore, a user may forget to clean the lint trap filter, resulting in accumulation of lint in the lint trap filter without being noticed by the user, which in turn obstructs the air circulation and significantly deteriorates a drying efficiency.

SUMMARY OF THE INVENTION

It is, therefore, an object of the present invention to provide a drum type washing and drying machine capable of preventing a user from forgetting to clean a filter, while providing a design for an improve user facility and a better appearance.

In accordance with a preferred embodiment of the present invention, there is provided a drum type washing and drying machine including: a rotary drum for accommodating laundry therein; a front frame for forming a front surface of a main body of the washing and drying machine, wherein the front frame is provided with a laundry loading/unloading opening through which laundry is loaded into or unloaded from the rotary drum; a detergent dispenser accommodated in the front frame; a dryer filter, accommodated in the front frame, for collecting therein lint generated during a drying process; and a control panel for setting an operation of the main body and displaying an operating state thereof, wherein the dryer filter and the detergent dispenser are substantially symmetrically disposed with respect to the control panel interposed therebetween.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, preferred embodiments of the present invention will be described with reference to the accompanying drawings. Here, it is to be noted that the present invention is not limited thereto.

Figure 1:
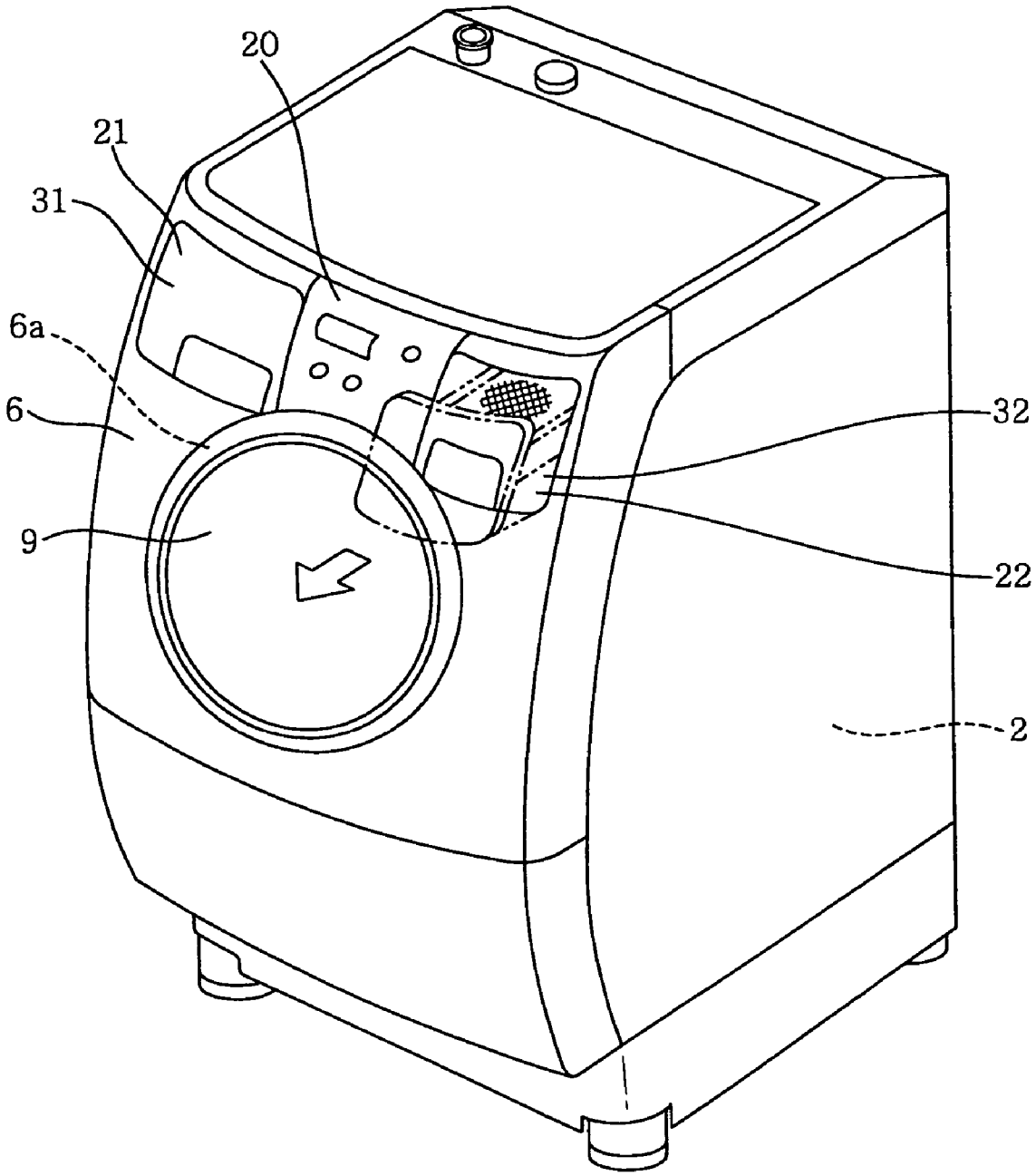
FIG. 1 is a perspective view of a drum type washing and drying machine in accordance with a preferred embodiment of the present invention.
Figure 2:
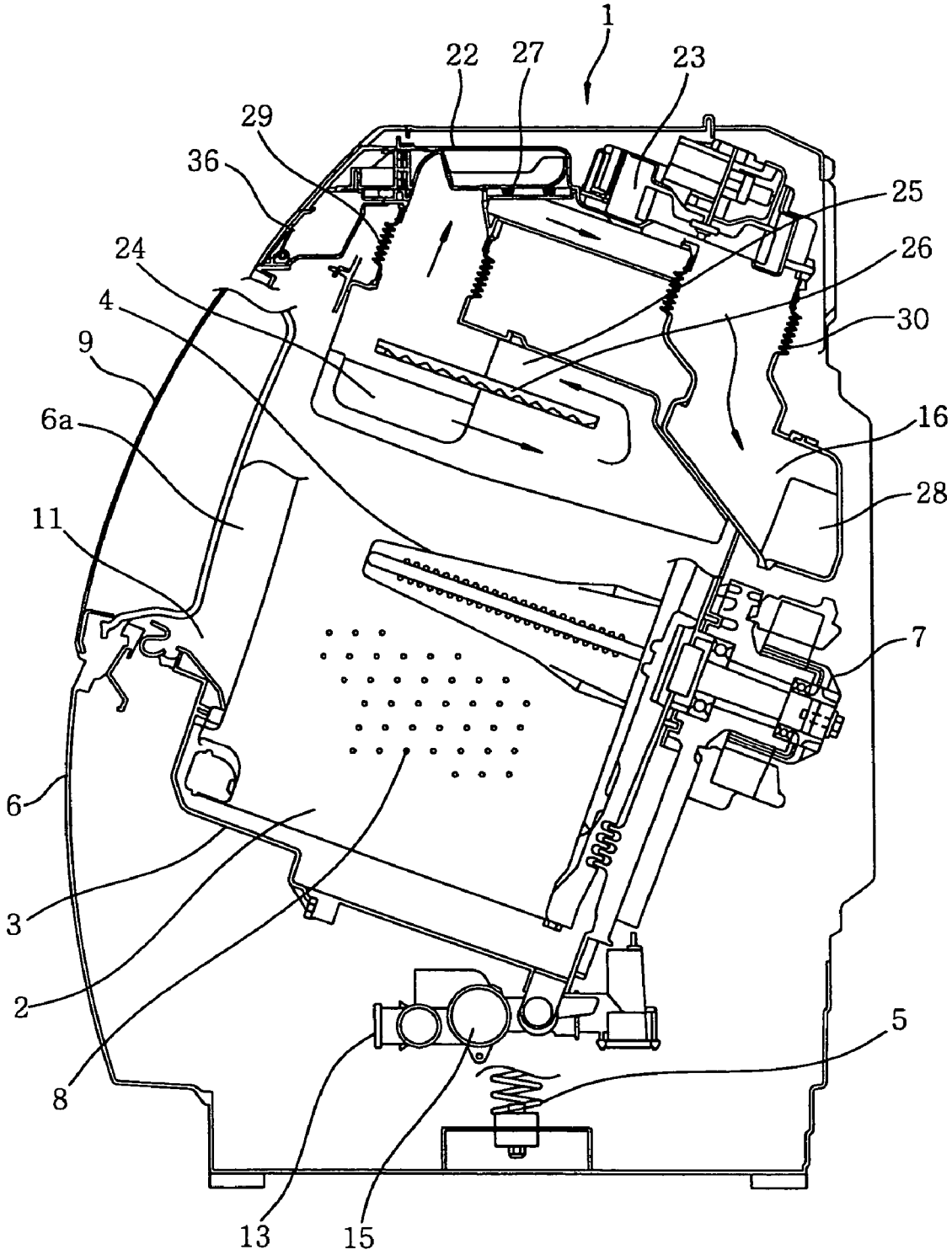
FIG. 2 presents a schematic cross sectional view of the drum type washing and drying machine in accordance with the preferred embodiment of the present invention.
Figure 3:
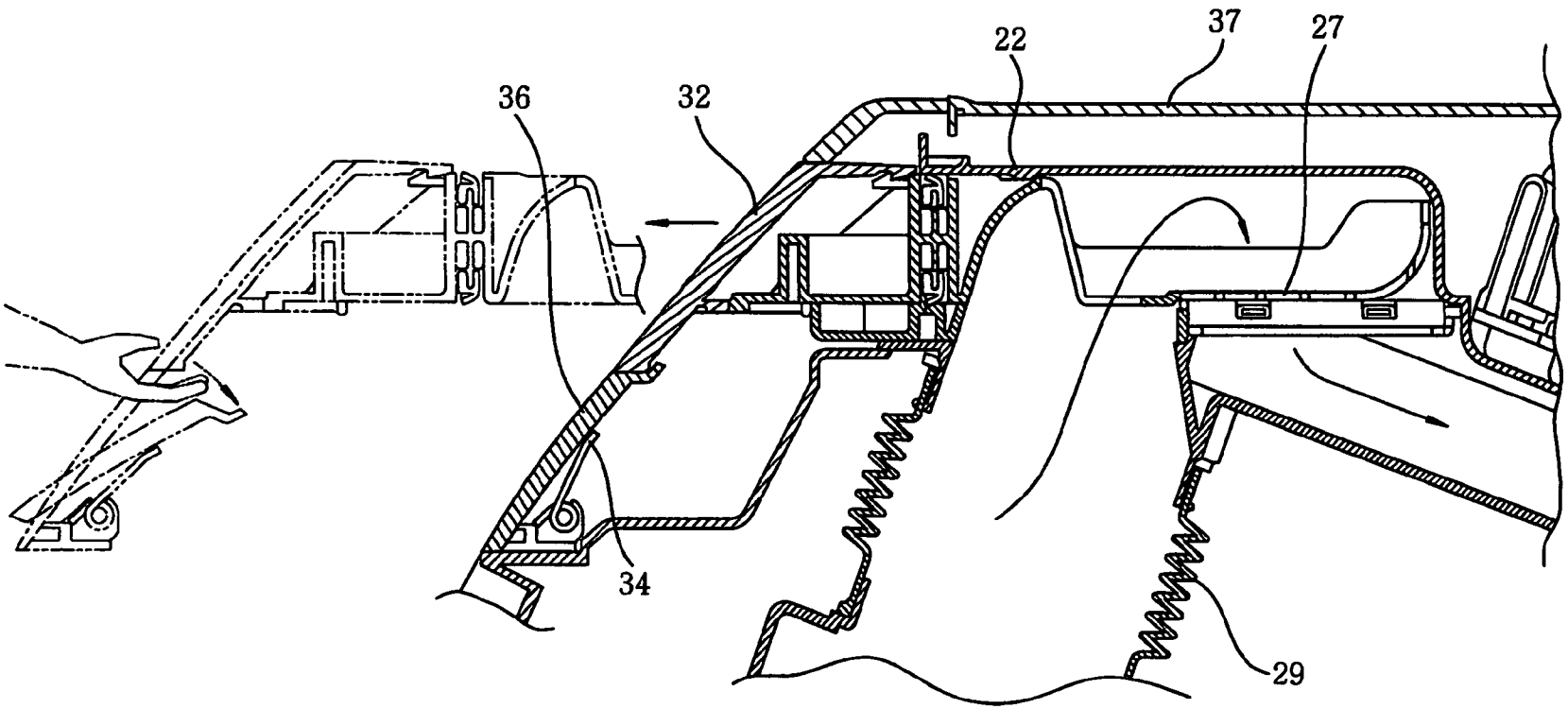
FIG. 3 sets forth a cross sectional view illustrating main components of a dryer filter of the drum type washing and drying machine in accordance with the preferred embodiment of the present invention.
Figure 4:
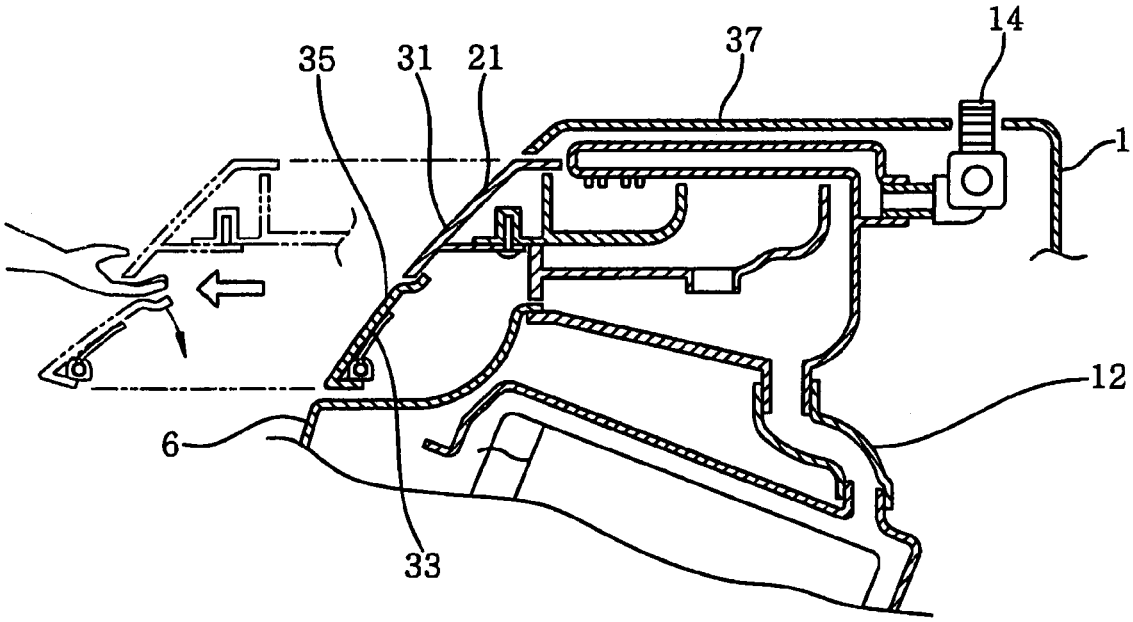
FIG. 4 provides a cross sectional view illustrating main components of a detergent dispenser of the drum type washing and drying machine in accordance with the preferred embodiment of the present invention.

A drum type washing and drying machine in accordance with a preferred embodiment of the present invention will be described in conjunction with FIGS. 1 to 4. FIG. 1 is a perspective view of the drum type washing and drying machine in accordance with the preferred embodiment of the present invention and FIG. 2 presents a schematic cross sectional view thereof. Further, FIGS. 3 and 4 set forth cross sectional views showing main components of a dryer filter and a detergent dispenser, respectively.

Main body 1 of the drum type washing and drying machine has therein water tub 3 supported on suspension structure 5, and cylindrical rotary drum 2 having a bottom surface is rotatably installed in water tub 3 such that the direction of its rotational axis is declined toward a rear side. Further, provided at a front side of water tub 3 is laundry loading/unloading opening 11 that is configured to be connected to an opening of rotary drum 2. After opening door 9 for opening or closing opening 6*a* provided at an inclined surface of front frame 6 forming a front surface of main body 1, laundry can be loaded into or unloaded from rotary drum 2 through laundry loading/unloading opening 11. By installing door 9 at the inclined surface, a user can load and unload the laundry without bending down, ameliorating the inconvenience of a conventional drum type washing machine employing a structure of loading and unloading laundry into and from rotary drum 2 through an opening provided to be opened in a horizontal direction.

Rotary drum 2 is provided with multiple drum perforations 8 communicating with water tub 3 on its cylindrical surface, and agitation blades 4 are installed at a plurality of locations on an inner cylindrical surface of rotary drum 2. Rotary drum 2 is driven to rotate in forward and backward direction by motor 7 installed in a rear side of water tub 3. Further, water supply conduit 12 and water drain conduit 13 are connected to water tub 3, and water supply and drain into and from water tub 3 are performed under a control of water supply valve 14 and water drain valve 15.

Control panel 20 is provided at an upper central portion of front frame 6, and detergent dispenser 21 and dryer filter 22 are symmetrically disposed with respect to control panel 20 interposed therebetween. After adding detergent into detergent dispenser 21 prior to starting the operation of the drum type washing and drying machine, control panel 20 can be manipulated as needed to set up a desired operation of the drum type washing and drying machine, start or temporarily pause the operation, and find out the operating status thereof.

When the operation of the drum type washing and drying machine is initiated after loading laundry into rotary drum 2 through opening door 9, water supply valve 14 is opened and a predetermined amount of water is fed into water tub 3 via water supply conduit 12. At this time, the detergent supplied into detergent dispenser 21 is dissolved in the water introduced into detergent dispenser 21 to be added into water tub 3. Then, rotary drum 2 is driven to rotate by motor 7 to initiate a washing process. As a result of the rotation of rotary drum 2 during the washing process, the laundry accommodated in rotary drum 2 is repeatedly lifted up in the drum's rotational direction by agitation blades 4 and then dropped. As the laundry is agitated in rotary drum 2, the laundry is subject to pounding motions to be washed.

After the lapse of a predetermined washing time, water drain valve 15 is opened, and soiled water is discharged from water tub 3 via water drain conduit 13. Then, by performing a water-extracting process wherein rotary drum 2 is rotated at a high rotational speed, water contained in the laundry is extracted therefrom. Thereafter, fresh water is fed into water tub 3 via water supply conduit 12, and a rinsing process is performed. During the rinsing process, the agitation of the laundry, wherein the laundry articles are lifted up by agitation blades 4 and dropped, is repeated by the rotation of rotary drum 2, thereby the rinsing process of the laundry being performed.

Moreover, the drum type washing and drying machine in accordance with the preferred embodiment has a drying function for drying the laundry accommodated in rotary drum 2. For the purpose, there is formed air circulation channel 16 for exhausting air in water tub 3, dehumidifying thus exhausted air, heating thus dehumidified air and recirculating thus heated dry air back into water tub 3. By rotating fan 23 disposed in air circulation channel 16, airflow is generated within air circulation channel 16. Specifically, damp air in rotary drum 2 accommodating wet laundry therein is blown into water tub 3 through drum perforations 8 and is directed into dehumidification pipe 25 via air outlet 24 of water tub 3. Disposed in dehumidification pipe 25 is heat exchanger plate 26 which is cooled down by, e.g., spray of water supplied from water supply valve 14. Thus, the damp air exhausted from water tub 3 is cooled while it passes through heat exchanger plate 26 and dehumidified as moisture contained therein is condensed.

Thus dehumidified air is then directed to lint trap filter 27 disposed in dryer filter 22, so that lint generated from the laundry during the drying process is removed therefrom. Then, the lint-free air is heated by a drying heater (not shown) and thus heated dry air is blown into warm air inlet 28 by fan 23 to be re-directed into rotary drum 2 via water tub 3. As such air circulation is repeated for a preset period of time, moisture contained in the laundry is gradually evaporated, and the drying process of the laundry is executed.

Every time the drying process is executed, lint would be accumulated in lint trap filter 27. Thus, unless it is cleaned, resistance in air circulation channel 16 may be increased, resulting in reduction of the volume of circulation air and deterioration of drying efficiency. Moreover, there is a likelihood that the lint collected in lint trap filter 27 would be dispersed out of it to re-attached to the laundry or obstruct air circulation channel 16. In the preferred embodiment of the present invention, however, dryer filter 22 is disposed right next to control panel 20 which is to be used by a user whenever the user operates the drum type washing and drying machine. Therefore the filter can hardly escape user's attention, thereby prompting the user to clean the filter every time the washing and drying machine is used. Therefore, the above-mentioned deterioration in drying efficiency due to the accumulation of lint can be avoided.

Moreover, by symmetrically installing detergent dispenser 21 and dryer filter 22 with respect to control panel 20 interposed therebetween, all parts with which the user has to make a contact whenever the machine is used are gathered at one area, whereby user convenience can be improved and the drum type washing and drying machine can be designed to have a good appearance. Further, dryer filter 22 accommodated in front frame 6 is connected to water tub 3 via bellows hoses 29 and 30 in such a way that vibrations transferred from water tub 3 which vibrates greatly during a water-extracting process can be absorbed. Accordingly, the lint collected in lint trap filter 27 can be prevented from being dispersed and dropped again due to the vibrations during the process. As a consequence, the lint trap function can be enhanced.

Furthermore, detergent dispenser 21 and dryer filter 22 accommodated in front frame 6 are configured such that they can be pulled forward from main body 1. Therefore, when a user removes lint from lint trap filter 27 after drawing out dryer filter 22 forwardly, lint trap filter 27 comes into a position where the amount of collected lint can be easily observed by the user, allowing the user to determine whether or not to clean lint trap filter 27 instantly. As a consequence, user convenience can be improved. Further, since detergent dispenser 21 and dryer filter 22 can be manipulated without being interfered by the presence of objects on top surface 37 of main body 1, effective use of top surface 37 is possible. Further, since no opening for the installation and separation of dryer filter 22 is provided on top surface 37, main body 1 can be installed even at a location that allows for little clearance space above top surface 37.

Moreover, in case dryer filter 22 is not completely fitted into front frame 6 when the user inserts dryer filter 22 into front frame 6, lint trap function during the drying process would become incomplete, incurring adverse effects of lint being re-attached to laundry or obstructing air circulation channel 16. However, since front faces 31 and 32 of detergent dispenser 21 and dryer filter 22 form the casing of main body 1 together with control panel 20 and front frame 6 when they are accommodated into front frame 6, there would be caused a step difference between front face 32 and control panel 20 and between front face 32 and front frame 6. Thus, by detecting the step difference, the user can easily notice the failure in fitting dryer filter 22. As a result, the problem of lint being re-attached to laundry or obstructing air circulation channel 16 can be prevented.

Further, rotatably installed at front faces 31 and 32 of detergent dispenser 21 and dryer filter 22 are handle covers 35 and 36 forwardly biased by bias springs 33 and 34, respectively. Handle covers 35 and 36 are disposed such that they are substantially symmetric with respect to a central line of main body 1 when viewed from front. In order to add detergent in detergent dispenser 21, user presses and rotates handle cover 35 backward to thereby expose an opening in that position, and pulls detergent dispenser 21 forward by inserting his/her fingers into the opening. After adding detergent, detergent dispenser 21 is put back again into front frame 6 completely.

Likewise, by pressing and rotating handle cover 36 backward to thereby expose an opening in that position and by pulling dryer filter 22 forward by inserting his/her fingers into the opening, the user can see lint collected in lint trap filter 27 and remove it when necessary. After removing the lint, dryer filter 22 is put back again into front frame 6. When detergent dispenser 21 and dryer filter 22 are fitted into front frame 6 completely, handle covers 35 and 36 are positioned on a same plane as front faces 31 and 32. Thus, only the outer peripheral lines of handle covers 35 and 36 are shown while handle covers 35 and 36 can be hidden from view. Accordingly, cutting of the front faces 31 and 32 for the formation of handles thereon is no longer required. Further, by disposing the outer peripheral lines of handle covers 35 and 36 symmetrically, the drum type washing and drying machine can be designed to have a good appearance.

In accordance with the preferred embodiment of the present invention, by disposing the dryer filter and the detergent dispenser on the front surface of the main body such that they are symmetric with respect to the control panel interposed therebetween, user convenience and design feature can be improved while preventing the incomplete accommodation of the dryer filter.

While the invention has been shown and described with respect to the preferred embodiments, it will be understood by those skill in the art that various changes and modifications may be made without departing form the spirit and scope of the invention as defined in the following claims.

What is claimed is:

1. A drum type washing and drying machine comprising:

a rotary drum to accommodate laundry therein;

a front frame for forming a front surface of a main body of the washing and drying machine, wherein the front frame is provided with a laundry loading/unloading opening through which laundry is loaded into or unloaded from the rotary drum;

a detergent dispenser accommodated in the front frame;

a dryer filter, accommodated in the front frame, for collecting therein lint generated during a drying process; and a control panel for setting an operation of the main body and displaying an operating state thereof, wherein the dryer filter and the detergent dispenser are substantially symmetrically disposed with respect to the control panel interposed therebetween, and wherein a forwardly biased handle cover is rotatably installed on a front face of each of the detergent dispenser and the dryer filter, and the handle covers are almost symmetrically disposed with respect to the control panel.

2. A drum type washing and drying machine comprising:

a main body;

a water tub suspended by a suspension structure;

a cylindrical rotary drum having a bottom surface to accommodate laundry therein, wherein the rotary drum has a cylindrical surface provided with multiple drum perforations communicating with the water tub;

a front frame forming a front surface of a main body of the washing and drying machine, wherein the front frame is provided with a laundry loading/unloading opening through which the laundry is loaded into or unloaded from the rotary drum;

a detergent dispenser accommodated in the front frame, wherein the detergent dispenser is allowed to be drawn out forwardly from an upper portion of the front frame, and detergent loaded in the detergent dispenser is dissolved in water introduced into the detergent dispenser from a water supply valve and is supplied into the water tub;

an air circulation channel for exhausting air from the water tub, dehumidifying the exhausted air, heating the dehumidified air and re-circulating the heated air back into the water tub, wherein the air circulation channel includes a rotating fan therein;

a dehumidification pipe constituting a part of the air circulation channel and connected with the water tub;

a dryer filter provided on the air circulation channel and including a lint trap filter for collecting therein lint generated during a drying process; and a control panel for setting an operation of the main body and displaying an operating state thereof, wherein the control panel disposed is on the upper portion of the front frame, wherein the dry filter is disposed such that the dehumidified air by the dehumidification pipe passes through the dryer filter before being heated, and allowed to be drawn out forwardly from the upper portion of the front frame, and wherein the dryer filter and the detergent dispenser are substantially symmetrically disposed with respect to the control panel interposed therebetween.

3. The machine of claim 2, wherein a forwardly biased handle cover is rotatably installed on a front face of each of the detergent dispenser and the dryer filter, and the handle covers are almost symmetrically disposed with respect to the control panel.

* * * * *